US011091354B2

(12) United States Patent
Shimizu

(10) Patent No.: US 11,091,354 B2
(45) Date of Patent: Aug. 17, 2021

(54) RAIL CLEANING DEVICE FOR PASSENGER CONVEYOR

(71) Applicant: Mitsubishi Electric Corporation, Tokyo (JP)

(72) Inventor: Takumi Shimizu, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 3 days.

(21) Appl. No.: 16/500,401

(22) PCT Filed: May 31, 2017

(86) PCT No.: PCT/JP2017/020289

§ 371 (c)(1),
(2) Date: Oct. 3, 2019

(87) PCT Pub. No.: WO2018/220753

PCT Pub. Date: Dec. 6, 2018

(65) Prior Publication Data

US 2021/0101786 A1 Apr. 8, 2021

(51) Int. Cl.

| | |
|---|---|
| ***B66B 31/00*** | (2006.01) |
| ***B65G 45/14*** | (2006.01) |
| ***B66B 23/02*** | (2006.01) |

(52) U.S. Cl.

CPC ..... *B66B 31/00* (2013.01); *B66B 23/024* (2013.01)

(58) Field of Classification Search

None

See application file for complete search history.

(56) References Cited

U.S. PATENT DOCUMENTS 6,527,103 B2 * 3/2003 Neszmerak ..... B66B 31/003 198/496
6,629,596 B2 * 10/2003 Teuber ..... B65G 45/18 198/496

(Continued)

FOREIGN PATENT DOCUMENTS

CN 102020189 A 4/2011
GB 462102 A 3/1937

(Continued)

OTHER PUBLICATIONS

International Search Report and Written Opinion dated Sep. 5, 2017 for PCT/JP2017/020289 filed on May 31, 2017, 8 pages including English Translation of the International Search Report.

*Primary Examiner* — Kavel Singh
(74) *Attorney, Agent, or Firm* — Xsensus LLP

(57) ABSTRACT

A rail cleaning device for a passenger conveyor includes: a main body; a cleaning body; and a fastening band. The main body has a through hole. The through hole is arranged so that lower ends of link plates are located at an intermediate position of the through hole in a height direction of the main body when the cleaning body is held in abutment against an upper surface of a drive rail. The fastening band has a ring shape passing through an inside of the through hole and over outer sides of the link plates and extending to an upper side of the main body. The fastening band is tightened so as to press the cleaning body onto the drive rail by bringing an upper end of the main body close to the lower ends of the link plates, thereby fastening the main body to the link plates.

13 Claims, 5 Drawing Sheets

(56) References Cited

U.S. PATENT DOCUMENTS

| | | | | |
|---|---|---|---|---|
| 6,923,312 | B2 * | 8/2005 | Pham | B41J 11/007 101/424 |
| 7,204,361 | B2 * | 4/2007 | Illedits | B66B 23/12 198/326 |
| 7,232,028 | B2 * | 6/2007 | Schulz | B66B 31/003 198/321 |
| 8,573,385 | B2 * | 11/2013 | Yun | B66B 31/003 198/498 |
| 2009/0025752 | A1 * | 1/2009 | Rui | B08B 1/008 134/6 |

FOREIGN PATENT DOCUMENTS

| | | | | |
|---|---|---|---|---|
| JP | 140264/1984 | U | | 9/1984 |
| JP | 147676/1987 | U | | 9/1987 |
| JP | 1-308389 | A | | 12/1989 |
| JP | 2007-84204 | A | | 4/2007 |
| JP | 2007084204 | A | * | 4/2007 |
| JP | 2011-514299 | A | | 5/2011 |
| JP | 2012-140238 | A | | 7/2012 |

* cited by examiner

RAIL CLEANING DEVICE FOR PASSENGER CONVEYOR

CROSS-REFERENCE TO RELATED APPLICATIONS

The present application is based on PCT filing PCT/JP2017/020289, filed May 31, 2017, the entire contents of which are incorporated herein by reference.

TECHNICAL FIELD

The present invention relates to a rail cleaning device for a passenger conveyor.

BACKGROUND ART

In some cases, dust or scrap metal falls onto a drive rail of a passenger conveyor due to construction work for a periphery of the passenger conveyor at the time of installation, and sand and dust brought by walkers are accumulated on the drive rail after operation of the passenger conveyor. The foreign matters on the rail lead to reduction in riding comfort and reduction in lifetime of a resin roller. Accordingly, cleaning is required at regular timings, for example, at the time of installation or maintenance. However, manual cleaning requires much time and effort because the drive rail is installed inside the passenger conveyor and a large number of drive rollers are provided on the rail. In particular, in a case of a passenger conveyor adopting a drive chain of an inner roller type in which drive rollers are arranged on an inner side of link plates, a work space is narrow, and hence manual cleaning is difficult.

For example, in Patent Literatures 1 and 2 below, there are proposed rail cleaning devices designed for a drive chain of an inner roller type. In Patent Literature 1, there is described a configuration in which the rail cleaning device is inserted on an inner side of link plates between a pair of drive rollers adjacent to each other in a circulating direction of the drive chain, and a cleaning body is pressed onto an upper surface of the drive rail through use of a plurality of rollers and an urging member. In Patent Literature 2, there is described a configuration in which a cleaning belt is wound between the drive rollers.

CITATION LIST

Patent Literature

[PTL 1] JP 2007-84204 A
[PTL 2] JP 2011-514299 A1

SUMMARY OF INVENTION

Technical Problem

In the configuration described in Patent Literature 1, the cleaning body is pressed onto the upper surface of the drive rail through use of, for example, the urging member, and hence a sufficient cleaning function can be obtained. However, in the configuration described in Patent Literature 1, the structure is complicated, with the result that device cost is increased. Meanwhile, in the configuration described in Patent Literature 2, the structure is simple, and hence manufacture with low cost is possible. However, depending on positions of the drive rollers, there is a case in which the drive rollers are not held in contact with the drive rail, that is, a case in which the drive rollers travel in a state of being slightly separated away from the drive rail. Accordingly, in the configuration described in Patent Literature 2, the cleaning belt is sometimes pressed onto the drive rail insufficiently, and hence a sufficient cleaning function cannot be obtained.

The present invention has been made to solve the above-mentioned problems, and has an object to provide a rail cleaning device for a passenger conveyor, which is capable of pressing a cleaning body onto a drive rail with an inexpensive configuration and by a sufficient force.

Solution to Problem

According to one embodiment of the present invention, there is provided a rail cleaning device for a passenger conveyor, which is mounted to a drive chain of an inner roller type in which drive rollers are arranged on an inner side of link plates, and is configured to clean, along with circulation drive of the drive chain, an upper surface of a drive rail on which the drive rollers roll, the rail cleaning device for a passenger conveyor including: a main body inserted on the inner side of the link plates between a pair of the drive rollers adjacent to each other in a circulating direction of the drive chain; a cleaning body provided below the main body; and a fastening band configured to fasten the main body to the link plates, wherein the main body has a through hole passing through the main body in a thickness direction of the main body, wherein the through hole is arranged so that lower ends of the link plates are located at an intermediate position of the through hole in a height direction of the main body when the cleaning body is held in abutment against the upper surface of the drive rail, and wherein the fastening band has a ring shape passing through an inside of the through hole and over outer sides of the link plates and extending to an upper side of the main body, and the fastening band is tightened so as to press the cleaning body onto the upper surface of the drive rail by bringing an upper end of the main body close to the lower ends of the link plates, thereby fastening the main body to the link plates.

Advantageous Effects of Invention

According to the rail cleaning device for a passenger conveyor of the present invention, the fastening band is formed into a ring shape passing through the inside of the through hole and over the outer sides of the link plates and extending to the upper side of the main body. Further, the fastening band is tightened so as to press the cleaning body onto the upper surface of the drive rail by bringing the upper end of the main body close to the lower ends of the link plates, thereby fastening the main body to the link plates. Accordingly, the cleaning body can be pressed onto the drive rail with an inexpensive configuration and by a sufficient force.

DESCRIPTION OF EMBODIMENTS

Modes for carrying out the present invention are described below based on embodiments with reference to the drawings.

First Embodiment

Figure 1:
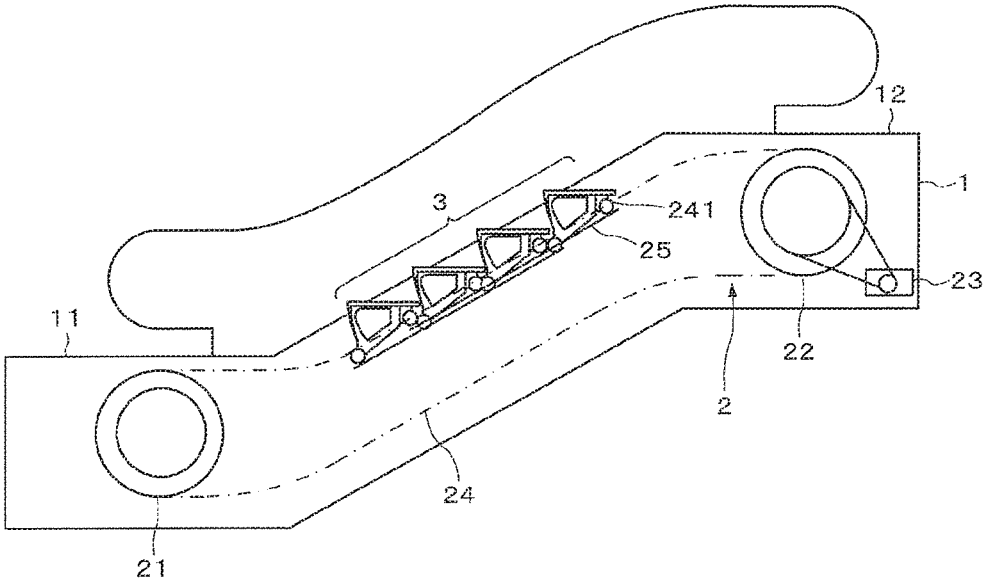
FIG. 1 is an explanatory view for illustrating a passenger conveyor to which a rail cleaning device for a passenger conveyor according to a first embodiment of the present invention is applied.

FIG. 1 is an explanatory view for illustrating a passenger conveyor to which a rail cleaning device for a passenger conveyor according to a first embodiment of the present invention is applied. As illustrated in FIG. 1, the passenger conveyor includes a truss 1, a driving device 2, and a plurality of footsteps 3.

The truss 1 is a frame extending from a first gate 11 to a second gate 12. FIG. 1 is an illustration of a case in which there is a height difference between the first gate 11 and the second gate 12. However, the first gate 11 and the second gate 12 may be arranged at the same height.

The driving device 2 is a device configured to drive the footsteps 3, and is arranged inside the truss 1. The driving device 2 includes a first sprocket 21, a second sprocket 22, a drive source 23, a drive chain 24, and a drive rail 25.

The first sprocket 21 is a toothed wheel arranged below the first gate 11. Similarly, the second sprocket 22 is a toothed wheel arranged below the second gate 12. The drive source 23 is coupled to the second sprocket 22, and is configured to drive the second sprocket 22 to rotate. As the drive source 23, for example, a motor can be used.

The drive chain 24 is an endless member wound around the first sprocket 21 and the second sprocket 22. Further, the drive chain 24 is coupled to each of the footsteps 3. When the second sprocket 22 is driven to rotate by a driving force of the drive source 23, the drive chain 24 and the footsteps 3 are driven to circulate between the first sprocket 21 and the second sprocket 22.

The drive rail 25 is a rail body extending in a circulating direction of the drive chain 24. When drive rollers 241 of the drive chain 24 are caused to roll on an upper surface of the drive rail 25, circulation of the drive chain 24 is guided by the drive rail 25. The upper surface of the drive rail 25 refers to a surface on which the drive rollers 241 are caused to roll.

Figure 2:
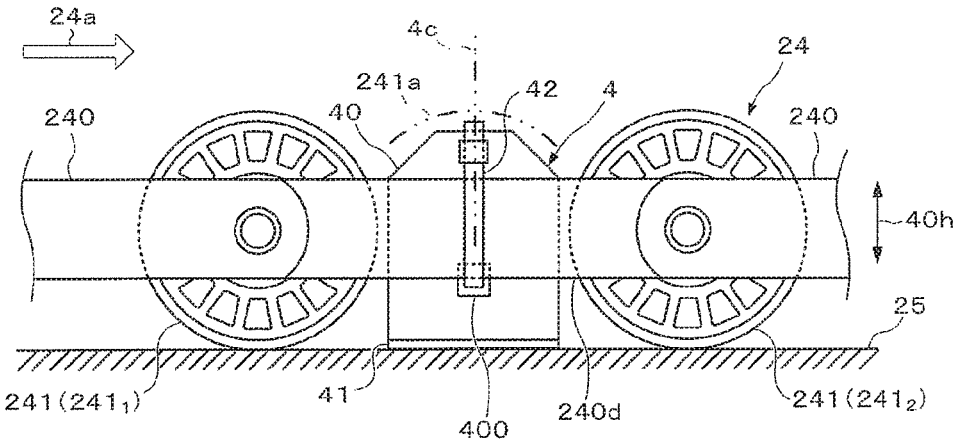
FIG. 2 is a side view for illustrating a drive chain of FIG. 1.
Figure 3:
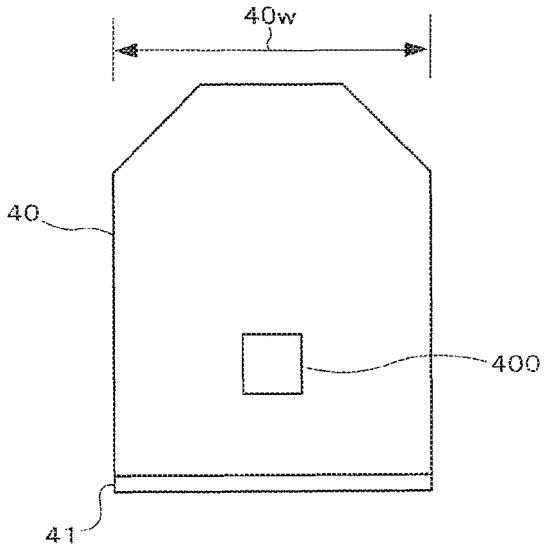
FIG. 3 is a side view for illustrating a main body and a cleaning body of the rail cleaning device of FIG. 2.
Figure 4:
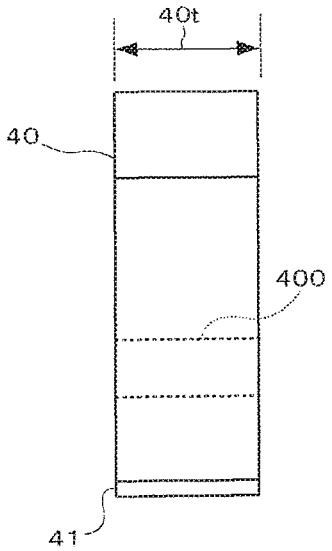
FIG. 4 is a front view for illustrating the main body and the cleaning body of FIG. 3.
Figure 5:
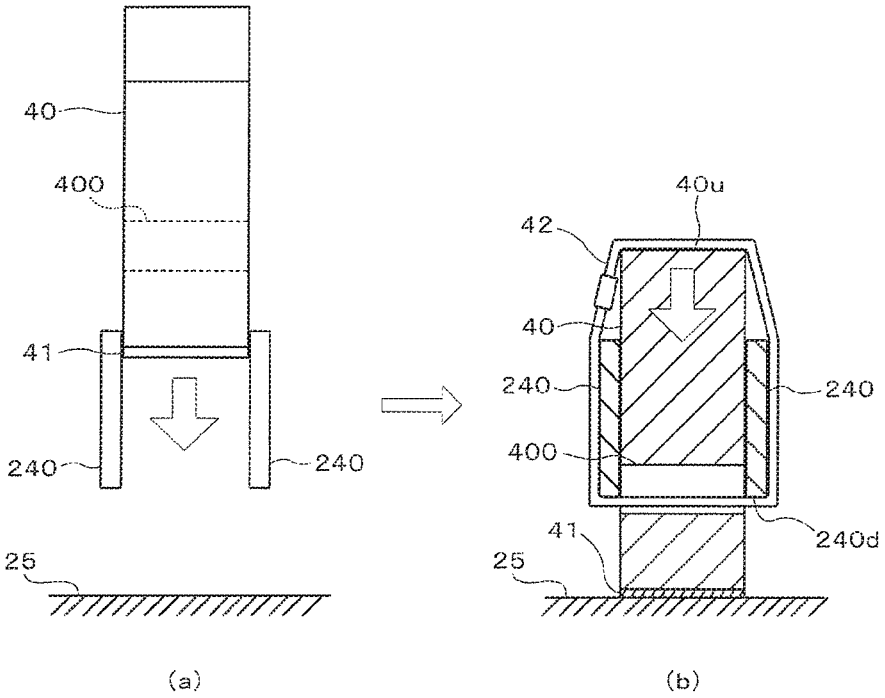
FIG. 5 are explanatory views for illustrating a method of mounting the main body and the cleaning body of FIG. 4 to the drive chain.

Next, FIG. 2 is a side view for illustrating the drive chain 24 of FIG. 1. FIG. 3 is a side view for illustrating a main body 40 and a cleaning body 41 of a rail cleaning device 4 of FIG. 2. FIG. 4 is a front view for illustrating the main body 40 and the cleaning body 41 of FIG. 3. FIG. 5 are explanatory views for illustrating a method of mounting the main body 40 and the cleaning body 41 of FIG. 4 to the drive chain 24.

As illustrated in FIG. 2, the drive chain 24 includes a plurality of link plates 240 and the plurality of drive rollers 241. One end of each of the link plates 240 is connected to another end of another link plate 240 so that the entire drive chain 24 is formed into an endless shape. Further, the link plates 240 are arranged on a near side and a far side of the drive roller 241 on the drawing sheet of FIG. 2. That is, the drive chain 24 in this embodiment is of an inner roller type in which the drive rollers 241 are arranged on an inner side of the link plates 240. The drive rollers 241 are coupled to the footsteps 3, respectively.

The rail cleaning device 4 is mounted to the drive chain 24. The rail cleaning device 4 is configured to clean the upper surface of the drive rail 25 along with circulation drive of the drive chain 24.

The rail cleaning device 4 includes the main body 40, the cleaning body 41, and a fastening band 42.

The main body 40 is a member having a rectangular parallelepiped contour as a whole. As illustrated in FIG. 2, an upper portion of the main body 40 has a shape suitable for arrangement within a shape corresponding to a contour 241*a* of the drive roller 241 under a state in which the rail cleaning device 4 is mounted to the drive chain 24. A center (axle) of the contour 241*a* of the drive roller 241 is arranged at a widthwise center position 40*c* of the main body 40 in a circulating direction 24*a* of the drive chain 24, and the contour 241*a* can be defined by an outer peripheral edge of the drive roller 241 placed on the upper surface of the drive rail 25. The upper portion of the main body 40 in this embodiment has, in side view, such a trapezoid shape that upper corners of the rectangular parallelepiped shape are cut out so as to allow the upper portion of the main body 40 to be arranged within the shape corresponding to the contour 241*a* of the drive roller 241. However, the upper portion of the main body 40 may have another shape suitable for arrangement within, for example, a semicircular shape corresponding to the contour 241*a* of the drive roller 241. As described above, the upper portion of the main body 40 has the shape suitable for arrangement within the shape corresponding to the contour 241*a* of the drive roller 241. Thus, at the time of circulation drive of the drive chain 24 under a state in which the rail cleaning device 4 is mounted to the drive chain 24, a risk of contact of the rail cleaning device 4 with another member can be reduced.

A width 40*w* (see FIG. 3) of the main body 40 is smaller than a clearance between a pair of drive rollers 241 adjacent to each other in the circulating direction of the drive chain 24. Further, a thickness 40*t* (see FIG. 4) of the main body 40 is smaller than a clearance between the link plates 240 arranged on both sides of the drive roller 241 (clearance between the link plates 240 orthogonal to the circulating direction of the drive chain 24). The main body 40 is arranged between the pair of drive rollers 241 ($\mathbf{241}_1$, $\mathbf{241}_2$) adjacent to each other in the circulating direction 24*a* of the drive chain 24, and is inserted on the inner side of the link plates 240.

The cleaning body 41 is provided below the main body 40. The cleaning body 41 is formed of, for example, felt, and is configured to clean the upper surface of the drive rail 25 by being pressed onto the upper surface of the drive rail 25.

The fastening band 42 is formed of a band-shaped member such as a rubber band or a cable tie, and is configured to fasten the main body 40 to the link plates 240.

Now, fastening of the main body 40 by the fastening band 42 is described in detail. First, the main body 40 has a through hole 400 passing through the main body 40 in a thickness direction thereof. The through hole 400 is arranged so that lower ends 240*d* of the link plates 240 are located at an intermediate position of the through hole 400 in a height direction 40*h* of the main body 40 when the cleaning body 41 is held in abutment against the upper surface of the drive rail 25. In other words, the through hole 400 is arranged across the lower ends 240*d* of the link plates 240 in the height direction 40*h* of the main body 40. A state in which the cleaning body 41 is held in abutment against the upper surface of the drive rail 25 refers to a state in which the cleaning body 41 is merely placed on the upper surface of the drive rail 25, and also refers to a state before the cleaning body 41 is pressed onto the upper surface of the drive rail 25 through tightening of the fastening band 42 as described later.

After the main body 40 is inserted on the inner side of the link plates 240 as illustrated in FIG. 5(*a*), the fastening band 42 is mounted to the main body 40 as illustrated in FIG. 5(*b*). On this occasion, the fastening band 42 is formed into a ring shape passing through an inside of the through hole 400 and over outer sides of the link plates 240 and extending to an upper side of the main body 40. When the fastening band 42 is tightened after the fastening band 42 is formed into a ring shape, an upper end 40*u* of the main body 40 is brought close to the lower ends 240*d* of the link plates 240 so that the cleaning body 41 is pressed onto the upper surface of the drive rail 25. Tightening of the fastening band 42 refers to reducing a circumferential length of the ring formed by the fastening band 42.

Figure 6:
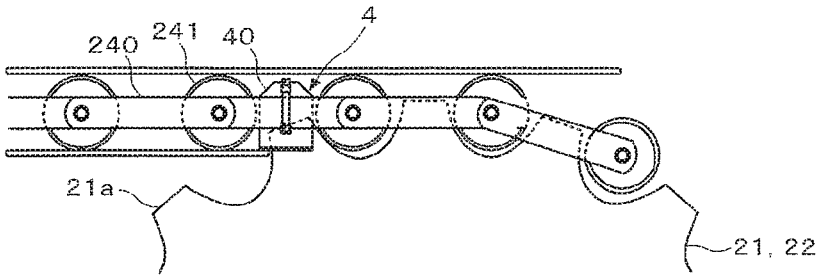
FIG. 6 is an explanatory view for illustrating a relationship between the rail cleaning device of FIG. 2 and a first sprocket or a second sprocket.

Next, FIG. 6 is an explanatory view for illustrating a relationship between the rail cleaning device 4 of FIG. 2 and the first sprocket 21 or the second sprocket 22. As described above, the main body 40 is inserted on the inner side of the link plates 240 between the pair of drive rollers 241 ($\mathbf{241}_1$, $\mathbf{241}_2$) adjacent to each other in the circulating direction 24*a* of the drive chain 24. Accordingly, at the time of circulation drive of the drive chain 24, there is a fear in that the main body 40 comes into contact with teeth 21*a* of the first sprocket 21 or the second sprocket 22. In order to prevent damage of a device other than the rail cleaning device 4, such as the teeth 21*a*, even when the main body 40 comes into contact with the teeth 21*a* of the first sprocket 21 or the second sprocket 22 as described above, it is preferred that the main body 40 be made of a material softer than a material for the teeth 21*a* of the first sprocket 21 or the second sprocket 22.

Further, it is preferred that a material forming the main body 40 be an elastic body. When the main body 40 is made of the elastic body softer than the material for the teeth 21*a*, damage of a device other than the rail cleaning device 4 can be prevented, and also the following advantage is obtained. That is, the main body 40 is compressed through tightening of the fastening band 42, thereby being capable of more reliably pressing the cleaning body 41 onto the drive rail 25. Further, even when the thickness 40*t* of the main body 40 is set larger than the clearance between the link plates 240 arranged on the both sides of the drive roller 241, the main body 40 can be inserted in a compressed manner between the link plates 240. When the thickness of the main body 40 is increased, a width of the cleaning body 41 can be increased, thereby being capable of increasing cleaning efficiency. In particular, it is further preferred that the main body 40 be made of a porous elastic body (rubber sponge).

In such rail cleaning device 4, the fastening band 42 is formed into a ring shape passing through the inside of the through hole 400 and over the outer sides of the link plates 240 and extending to the upper side of the main body 40. Further, the fastening band 42 is tightened so as to press the cleaning body 41 onto the upper surface of the drive rail 25 by bringing the upper end 40*u* of the main body 40 close to the lower ends 240*d* of the link plates 240, thereby fastening the main body 40 to the link plates 240. Accordingly, the cleaning body 41 can be pressed onto the drive rail 25 with an inexpensive configuration and by a sufficient force.

Further, the upper portion of the main body 40 has a shape suitable for arrangement within the shape corresponding to the contour of the drive roller 241. Thus, at the time of circulation drive of the drive chain 24 under a state in which the rail cleaning device 4 is mounted to the drive chain 24, a risk of contact of the rail cleaning device 4 with another member can be reduced.

Moreover, the main body 40 is made of the material softer than the material for the teeth 21*a* of the sprocket 21 or the sprocket 22 around which the drive chain is wound. Accordingly, even when the main body 40 comes into contact with the teeth 21*a* of the first sprocket 21 or the second sprocket 22, a risk of damage of a device other than the rail cleaning device 4, such as the teeth 21*a*, can be reduced.

Moreover, the material for the main body 40 is the elastic body. Accordingly, the main body 40 is compressed through tightening of the fastening band 42, thereby being capable of more reliably pressing the cleaning body 41 onto the drive rail 25. Further, even when the thickness 40*t* of the main body 40 is set larger than the clearance between the link plates 240 arranged on the both sides of the drive roller 241, the main body 40 can be inserted in a compressed manner between the link plates 240. When the thickness of the main body 40 is increased, the width of the cleaning body 41 can be increased, thereby being capable of increasing cleaning efficiency.

Second Embodiment

Figure 7:
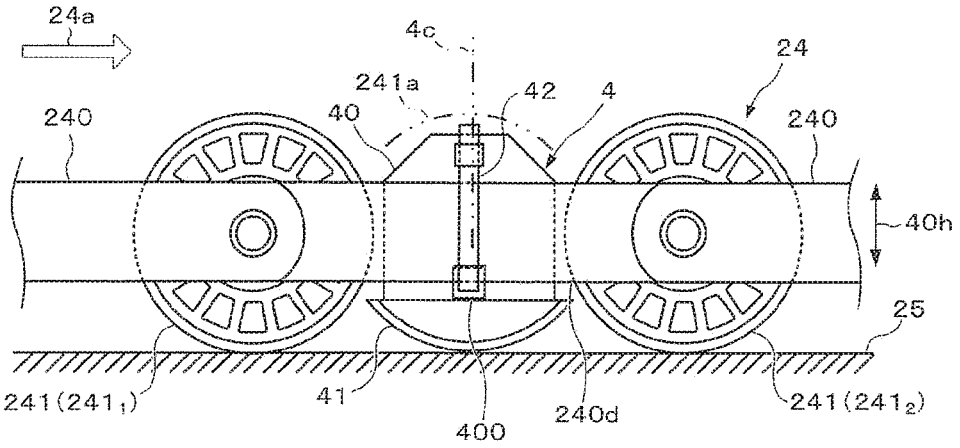
FIG. 7 is a side view for illustrating the rail cleaning device for a passenger conveyor according to a second embodiment of the present invention.
Figure 8:
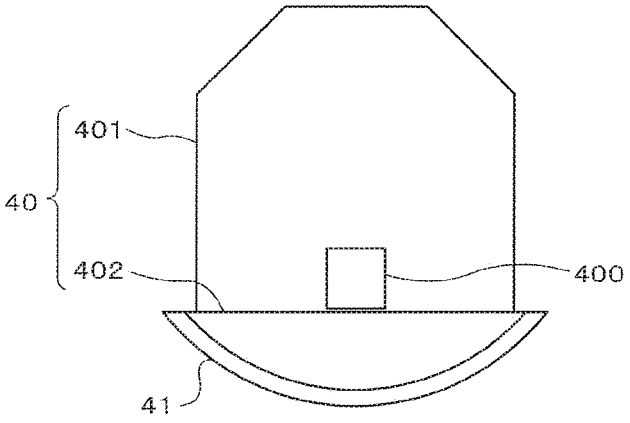
FIG. 8 is a side view for illustrating the main body and the cleaning body of the rail cleaning device of FIG. 7.
Figure 9:
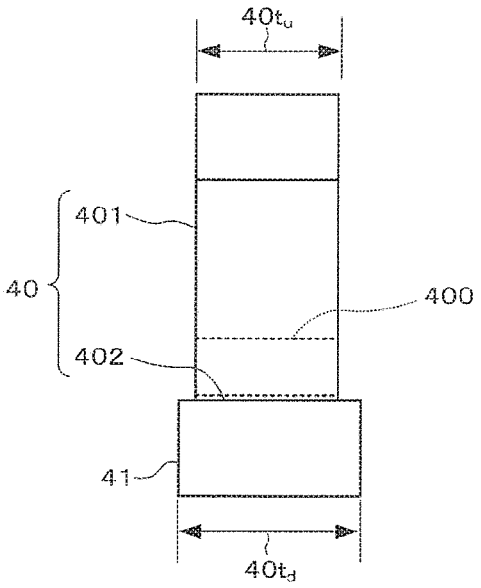
FIG. 9 is a front view for illustrating the main body and the cleaning body of FIG. 8.
Figure 10:
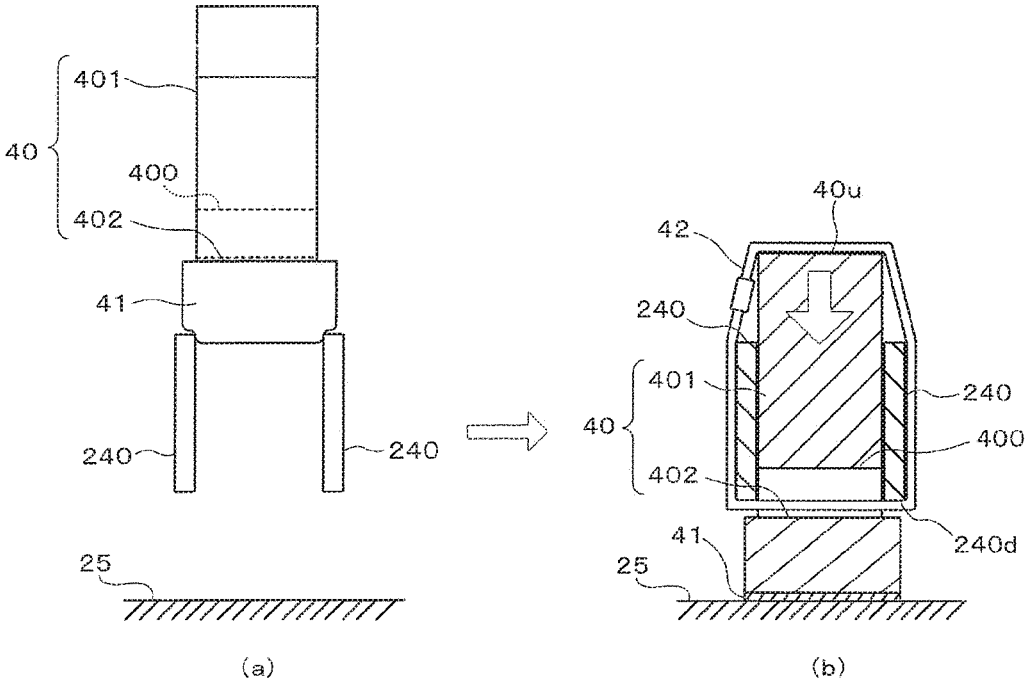
FIG. 10 are explanatory views for illustrating a method of mounting the main body and the cleaning body of FIG. 9 to the drive chain.

FIG. 7 is a side view for illustrating the rail cleaning device 4 for a passenger conveyor according to a second embodiment of the present invention. FIG. 8 is a side view for illustrating the main body 40 and the cleaning body 41 of the rail cleaning device 4 of FIG. 7. FIG. 9 is a front view for illustrating the main body 40 and the cleaning body 41 of FIG. 8. FIG. 10 are explanatory views for illustrating a method of mounting the main body 40 and the cleaning body 41 of FIG. 9 to the drive chain 24.

The main body 40 in the second embodiment includes an upper main body 401 and a lower main body 402 (cleaning-body base). The upper main body 401 has the same shape as that of the upper portion of the main body 40 in the first embodiment. The lower main body 402 has a semi-cylindrical contour. A lower surface 402*a* of the lower main body 402 is formed into an arc surface. The cleaning body 41 is provided along the arc surface (lower surface 402*a* of the lower main body 402). When the drive chain 24 is driven to circulate while the cleaning body 41 is pressed onto the drive rail 25, a posture of the rail cleaning device 4 may be changed by, for example, a frictional force between the drive rail 25 and the cleaning body 41. In a case in which the cleaning body 41 is provided along the arc surface as described above, even when the posture of the rail cleaning device 4 is changed, the cleaning body 41 can be kept being pressed onto the drive rail 25, thereby being capable of avoiding reduction in cleaning efficiency due to the change of the posture of the rail cleaning device 4.

The upper main body 401 and the lower main body 402 are each made of the elastic body. A thickness $\mathbf{40}t_u$ of the upper main body 401 is set smaller than the clearance between the link plates 240 arranged on the both sides of the drive roller 241. Meanwhile, a thickness $\mathbf{40}t_d$ of the lower main body 402 is set larger than the clearance between the link plates 240 arranged on the both sides of the drive roller 241. Even when the thickness $\mathbf{40}t_d$ of the lower main body 402 is set larger than the clearance between the link plates 240, as illustrated in FIG. 10(*a*), the lower main body 402 can be inserted between the link plates 240 while being compressed. When the thickness $\mathbf{40}t_d$ of the lower main body 402 is increased, the width of the cleaning body 41 can be increased, thereby being capable of increasing cleaning efficiency. Other configurations are the same as those of the first embodiment.

In such rail cleaning device 4, the cleaning body 41 is provided along the arc surface. Accordingly, even when the posture of the rail cleaning device 4 is changed, the cleaning body 41 can be kept being pressed onto the drive rail 25, thereby being capable of avoiding reduction in cleaning efficiency due to the change of the posture of the rail cleaning device 4.

The invention claimed is:

1. A rail cleaning device for a passenger conveyor, which is mounted to a drive chain of an inner roller type in which drive rollers are arranged on an inner side of link plates, and is configured to clean, along with circulation drive of the drive chain, an upper surface of a drive rail on which the drive rollers roll, the rail cleaning device for a passenger conveyor comprising:

a main body inserted on the inner side of the link plates between a pair of the drive rollers adjacent to each other in a circulating direction of the drive chain;

a cleaning body provided below the main body; and a fastening band configured to fasten the main body to the link plates, wherein the main body has a through hole passing through the main body in a thickness direction of the main body, wherein the through hole is arranged so that lower ends of the link plates are located at an intermediate position of the through hole in a height direction of the main body when the cleaning body is held in abutment against the upper surface of the drive rail, and wherein the fastening band has a ring shape passing through an inside of the through hole and over outer sides of the link plates and extending to an upper side of the main body, and the fastening band is tightened so as to press the cleaning body onto the upper surface of the drive rail by bringing an upper end of the main body close to the lower ends of the link plates, thereby fastening the main body to the link plates.

2. The rail cleaning device for a passenger conveyor according to claim 1, wherein an upper portion of the main body has a shape suitable for arrangement within a shape corresponding to a contour of each of the drive rollers.

3. The rail cleaning device for a passenger conveyor according to claim 1, wherein the cleaning body is provided along an arc surface.

4. The rail cleaning device for a passenger conveyor according to claim 1, wherein the main body is made of a material softer than a material for teeth of a sprocket around which the drive chain is wound.

5. The rail cleaning device for a passenger conveyor according to claim 4, wherein the material comprises an elastic body.

6. The rail cleaning device for a passenger conveyor according to claim 2, wherein the cleaning body is provided along an arc surface.

7. The rail cleaning device for a passenger conveyor according to claim 2, wherein the main body is made of a material softer than a material for teeth of a sprocket around which the drive chain is wound.

8. The rail cleaning device for a passenger conveyor according to claim 3, wherein the main body is made of a material softer than a material for teeth of a sprocket around which the drive chain is wound.

9. The rail cleaning device for a passenger conveyor according to claim 6, wherein the main body is made of a material softer than a material for teeth of a sprocket around which the drive chain is wound.

10. The rail cleaning device for a passenger conveyor according to claim 7, wherein the material comprises an elastic body.

11. The rail cleaning device for a passenger conveyor according to claim 8, wherein the material comprises an elastic body.

12. The rail cleaning device for a passenger conveyor according to claim 9, wherein the material comprises an elastic body.

13. A rail cleaning device, comprising:

a main body to be inserted on an inner side of link plates between a pair of drive rollers adjacent to each other;

a cleaning body below the main body; and a fastening band configured to fasten the main body to the link plates, wherein the main body has a through hole passing through the main body in a thickness direction of the main body, wherein the through hole is configured so that lower ends of the link plates are to be located at an intermediate position of the through hole in a height direction of the main body, and wherein the fastening band has a ring shape to pass through an inside of the through hole and over outer sides of the link plates and extending to an upper side of the main body, and the fastening band is configured to be tightened to bring an upper end of the main body close to the lower ends of the link plates.

* * * * *